United States Patent [19]

Whitney et al.

[11] 4,394,958

[45] Jul. 26, 1983

[54] AIR FLOW AND CONDITION RESPONSIVE DAMPER

[75] Inventors: John A. Whitney, Fort Wayne; Richard Rosenbrock, Bluffton, both of Ind.

[73] Assignee: Franklin Electric Co., Inc., Bluffton, Ind.

[21] Appl. No.: 333,753

[22] Filed: Dec. 23, 1981

[51] Int. Cl.[3] ..... F24F 13/06

[52] U.S. Cl. ..... 236/49; 236/9 A; 236/84; 98/102; 98/106

[58] Field of Search ..... 236/49, 9 A, 10, 84; 137/487.5; 98/102, 106, 117

[56] References Cited

U.S. PATENT DOCUMENTS

| | | | |
|---|---|---|---|
| 2,274,614 | 2/1942 | Nessell | 236/9 A X |
| 3,158,319 | 11/1964 | Nelson | 236/9 A |
| 3,776,214 | 12/1973 | Coffman | 126/113 |
| 4,277,019 | 7/1982 | Shreve | 236/49 |

*Primary Examiner*—William E. Tapolcai

*Attorney, Agent, or Firm*—Merriam, Marshall & Bicknell

[57] ABSTRACT

Apparatus for controlling the air flow from a register of a forced air heating system. The apparatus includes walls forming a housing or cover that is adapted to be fastened to and enclose an air outlet register. The walls also form an outlet opening, and a pivotable flapper valve or wall is provided that is movable to close the opening. The valve is pivotable between an open position where the opening is not closed, and a closed position where the opening is obstructed, the valve being biased to the open position. The valve is located to be subjected to the force of air moving out of the register and through the housing, this force being such as to urge the valve to the closed position. The apparatus further includes a latch for holding the valve in the open position against the force of the moving air, and an electric control for disabling the latch in the presence of the flow of air. The electric control may be manually operated or it may be responsive to the ambient temperature conditions.

15 Claims, 8 Drawing Figures

AIR FLOW AND CONDITION RESPONSIVE DAMPER

This invention relates to apparatus for conserving energy and increasing the comfort of the occupants of a home or building that is heated and/or cooled by a forced air system. Such a system usually includes a central heating and/or cooling plant and a network of air ducts that lead from the plant to the various rooms to be heated and/or cooled. A blower forces air through the plant and the ducts and into the rooms through registers located in the rooms. The registers may be floor registers or wall registers.

It is a common occurrence that such a system is not balanced; that is, one room or a number of rooms receive a larger amount of the air than the remaining rooms. It also frequently happens that some of the rooms are not used for a time, and it is advantageous to close off the air flow to such rooms.

It is widely recognized that an arrangement that makes it possible to control the air flow to each of the rooms would conserve energy by closing off the air flow to rooms where it is not needed. Such an arrangement would also increase the comfort of the occupants by allowing an adjustment in each room. Arrangements of this nature have been provided in the past, but they have been quite expensive and not suited for easy addition to an existing forced air system.

It is a general object of the present invention to provide apparatus that avoids the foregoing problems.

Apparatus in accordance with this invention comprises a housing or cover that may be included as part of an air outlet register or is adapted to be fastened to and enclose an existing air outlet register. The housing includes an outlet opening and a pivotable flapper valve or wall that is movable to close the opening. The valve is pivotable between an open position where the opening is not closed, and a closed position where the opening is obstructed, the valve being biased to the open position. The valve is located to be subjected to the force of air moving out of the register and through the housing, this force being such as to urge the valve to the closed position. The apparatus further includes a latch for holding the valve in the open position against the force of the moving air, and an electric control for disabling the latch in the pressure of the flow of air.

The invention will be better understood from the following detailed description taken in conjunction with the accompanying figures of the drawings, wherein.

In the description and claims herein, certain terms are used to designate the position of one part relative to another part, such as above or below, and the directions of movement. It should be understood that these terms are used only to clarify the description and the claims, and that the apparatus may have various physical orientations before and during use.

Figure 1:
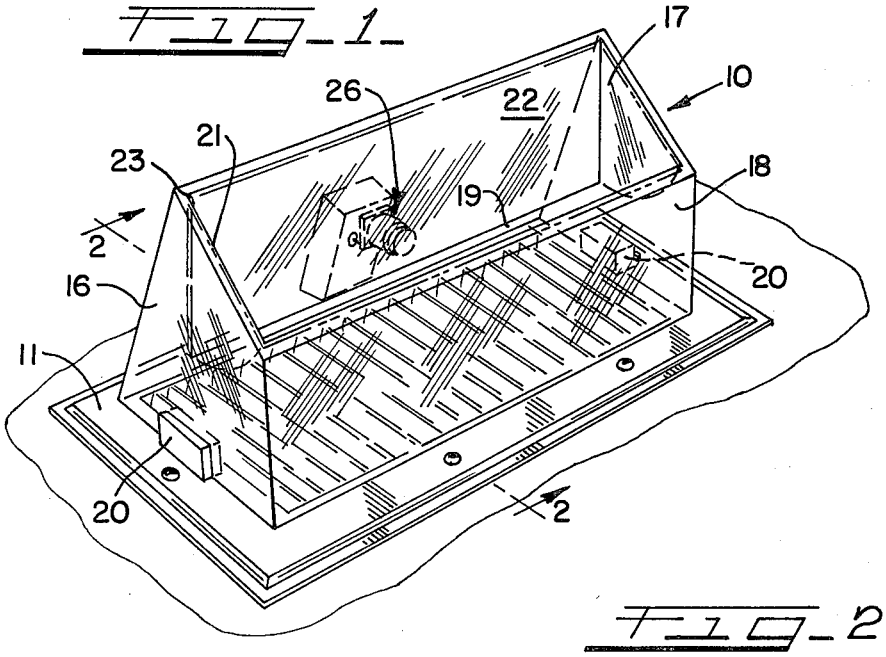
FIG. 1 is a perspective view of apparatus in accordance with the invention.
Figure 2:
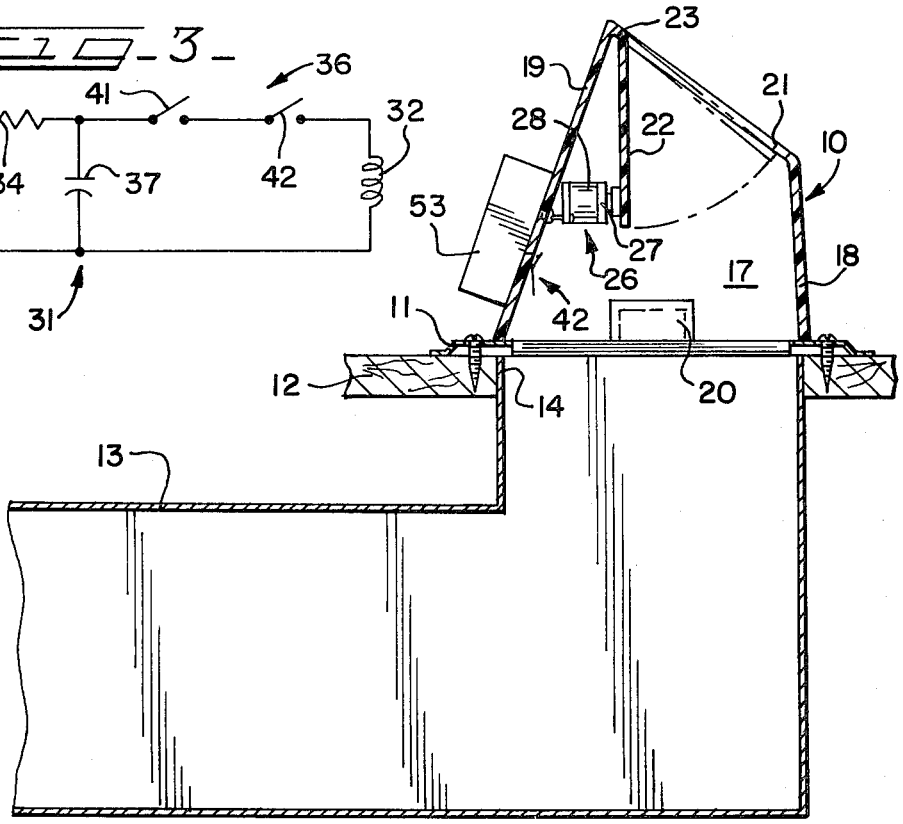
FIG. 2 is a sectional view taken on the line 2—2 of FIG. 1.

With reference to FIGS. 1 and 2, the apparatus includes a housing or cover 10 that is adapted to be positioned over an air outlet register 11 of a forced air heating and/or cooling system. The apparatus illustrated in FIGS. 1 and 2 is for use with a floor register of such a system, and the numeral 12 indicates the upper surface of a floor of, for example, a residence. An air duct 13 is mounted within the floor and has an opening 14 for the outlet of air from the duct, and the register 11 is mounted over the opening 14. As is customary in forced air systems, the air duct 13 is connected to the air outlet side of a blower (not shown) that is part of a central heating and/or cooling system. When the blower is energized, air is forced through the duct 13 and passes through the register 11 and enters the room to be heated or cooled.

As previously mentioned, the housing 10 covers or encloses the register 11, and in the specific example illustrated in FIGS. 1 and 2, the housing 10 includes two side walls 16 and 17, a front wall 18 and a back wall 19, which are connected at their ends to form a generally rectangular enclosure. The housing may be fastened to the register by various means, and in the present examples, two permanent magnets 20 on the side walls 16 and 17 fasten the housing to the register 11. The lower edges of the walls form a lower opening, and they are located to encompass the outer parts of the register 11. The housing 10 further includes an upper opening 21 which is opposite from the lower opening that encloses the register 11.

While the housing shown in the drawings is designed to be attached to an existing air outlet register, the housing and the register could be manufactured as a single unit or the housing may replace the register as part of an original installation.

The apparatus further includes a movable wall or flapper valve 22 that is pivotably mounted on the outer walls 16–19. In the present example, an edge of the flapper valve 22 is pivotably connected by a hinge 23 to the upper edge of the back wall 19. The flapper valve 22 is dimensioned so that it is able to completely obstruct and close off the upper opening of the housing 10 when it is in its closed position as shown in dashed lines in FIGS. 1 and 2. The flapper valve 22 is movable on the axis of the hinge 23 between an open position shown in full lines in FIGS. 1 and 2 and the closed position shown in dashed lines.

From FIG. 2, it will be noted that the flapper valve 22 is located, when it is in the open position, to extend into the stream of air flowing from the air duct 13, through the register 11, and out of the housing 10 through the upper opening 21. The movement of this stream of air creates a force or pressure on the flapper valve 22 which tends to swing the valve 22 from the open position to the closed position.

Figure 4:
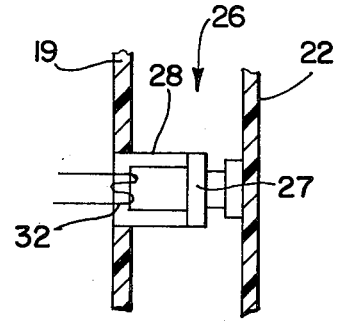
FIG. 4 is an enlarged view of a latch of the apparatus.

The apparatus further includes a latch 26 shown in FIG. 2 and in greater detail in FIG. 4. In the present specific example, the latch 26 includes a permanent magnet 27 that is secured to the inner or back side of the flapper valve 22, and a soft magnetic core 28 that is fastened to the back wall 19. The magnet 27 and the core 28 are located so that they engage as shown in FIGS. 2 and 4 when the flapper valve 22 is in the fully open position. The magnetic force of attraction between the magnet and the core is sufficient to hold the flapper valve 22 in the open position against the force of the moving air when the blower is energized. Consequently, if the valve 22 is in the open position when the blower is turned on, the latch will normally hold the flapper valve in the open position so that air leaving the register will flow unimpeded through the upper opening 21. In the embodiment of the invention shown in FIGS. 1 and 2, the flapper valve 22 extends nearly vertically downwardly from the hinge 23 when the valve is in its open position, with the result that the force of gravity acting on the valve 22 swings the valve to the open position, where it is held by the latch.

Figure 3:
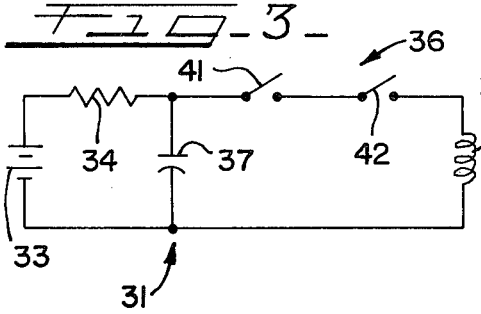
FIG. 3 is a schematic electrical diagram of a control of the apparatus.

The apparatus further includes a control 31, shown in detail in FIG. 3, for disabling the latch 26 and enabling the force of the moving air to swing the flapper valve to the closed position. In the present example, the control 31 includes a coil 32 (FIGS. 3 and 4) which is wound around the core 28. The core 28 and the coil 32 thus form an electromagnet, and a current pulse through the coil 32 in the proper direction will cause the core 28 to repel the magnet 27. The coil 32 is connected in series with a power supply, which in the present example is a battery, with a resistor 34 and with control switches 36. A capacitor 37 is connected across the battery 33 and the resistor 34. When one or all of the control switches 36 are open, the battery 33 charges the capacitor 37, and, of course, when the capacitor is completely charged, current ceases to flow through the battery-resistor-capacitor circuit. When all of the control switches 36 are closed, the capacitor 37 discharges through the coil 32 and creates a current pulse which repels the magnet 27 as previously mentioned. The resistor 34 preferably has a very high value to prevent the battery from being drained when the switches are closed. One of the control switches 36 is sensitive to the flow of air through the housing so that the current pulse occurs after the air flow has been established. If the pulse were to occur before the air flow started, the valve 22 would fall back and latch again and the valve 22 would remain open because only one pulse is generated. The current path through the coil is disrupted as soon as the flapper valve is closed and air flow ceases, as will be further described hereinafter.

Figure 5:
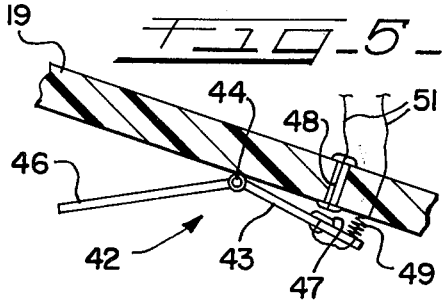
FIG. 5 is an enlarged sectional view of a part of the apparatus shown in FIG. 2.

The control switches 36 include, in the present specific example, a thermostatic switch 41 and a flow switch 42 that responds to the flow of air through the housing 10. A suitable flow switch 42 is illustrated in FIG. 5, and includes a leaf 43 that is pivotably mounted on the back wall 19 by a hinge 44. A flap or sail 46 is secured to and pivots with the leaf 43. A movable electric contact 47 is secured to the leaf 43 and a mating stationary contact 48 is secured to the back wall 19. A compression spring 49 is connected between the back wall 19 and the leaf 43 and tends to pivot the leaf 43 and the sail 46 in the clockwise direction and thereby hold the contacts 47 and 48 out of engagement. An electrical connection between the remainder of the FIG. 3 circuit and the contacts 47 and 48 is made, in the present specific example, by wires 51 and by the spring 49. The sail 46 is located, as shown in FIG. 2, in the path of the air flow so that the movement of air through the housing 10 will exert a force on the sail 46 and swing the leaf 43 in the counterclockwise direction, as seen in FIG. 5, to close the contacts 47 and 48. Thus, the switch 42 is responsive to the air flow and is closed only when air flows through the housing.

The operation of the apparatus shown in FIGS. 1 through 5 is as follows: If the blower of the central heating and/or cooling system is off, there is no air flow through the housing 10, and the flapper valve 22 is held in the open position by the latch 26 as shown in FIG. 2. The flow switch 42 is open in the absence of air flow, and the condition of the thermostatic switch 41 depends on the temperature of the air in the room and on its setting. When the apparatus is being used for heating, assuming that the temperature in the room is relatively low and that the switch 41 is designed to close with a temperature increase above a set level, the switch 41 will also be open at a low temperature. When the central blower is turned on, either manually or in response to a seperate thermostatic control, air will flow through the housing 10, past the flow switch 42 and the flapper valve 22, and out of the upper opening 21 of the housing 10, and the movement of air swings the flow switch 42 to the closed position. However, the latch 26 is strong enough to hold the flapper valve 22 in the open position against the force of the moving air. The heated air then flows into the room and heats it. When the thermostatic switch 41 closes, all of the control switches 36 are closed, the capacitor 37 discharges through the control switches, and the current pulse through the coil 32 causes the core 28 to repel the magnet 27. The latch 26 is thereby released and the force of the moving air quickly swings the flapper valve 22 in the counterclockwise direction as seen in FIG. 2 to the closed position. The movement of air through the housing 10 is then obstructed and the flow switch 42 moves to the open position once again due to the spring 49, thereby disrupting the current flow through the coil 32 and causing the capacitor 37 to recharge. The flapper valve 22 then remains in the closed position so long as the central blower is on, but when the blower is turned off the force of gravity swings the valve 22 back to the open position and re-engages the latch 26.

The control circuit 31 is preferably mounted on the outer surface of the back wall 19 adjacent the magnetic latch 26 and the sail switch 42, as shown in FIG. 2. A cover 53 is preferably provided to enclose the control circuit including the battery 33.

Figure 6:
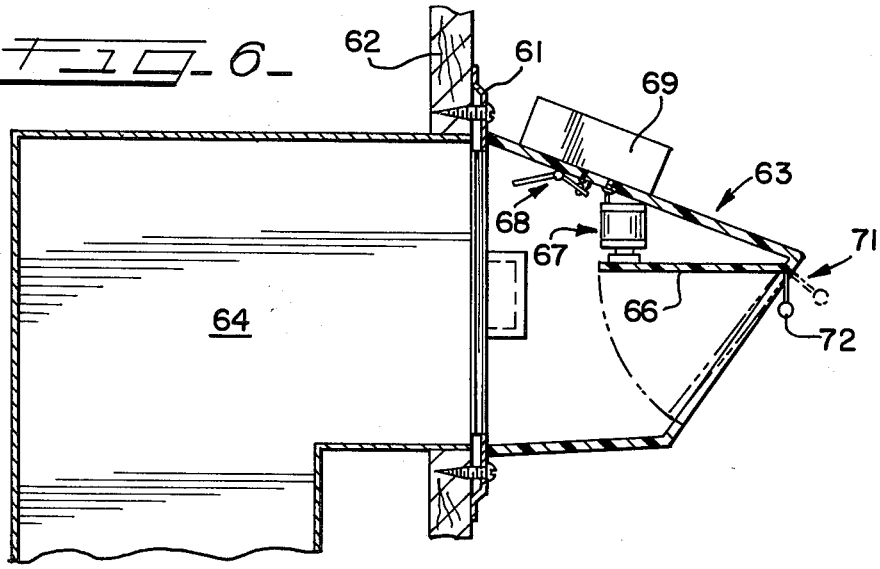
FIG. 6 is a view generally similar to FIG. 2 but showing an alternative arrangement.
Figure 7:
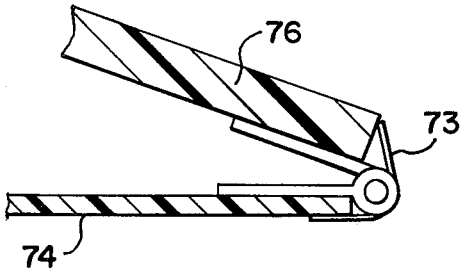
FIG. 7 is a sectional view showing still another alternative form of the invention.

The arrangement shown in FIGS. 1 and 2 is suitable for use with a floor register, and FIGS. 6 and 7 show arrangements for use with registers mounted on a vertical wall. With reference to FIG. 6, a register 61 is mounted on a vertical wall 62 and a housing 63 is fastened to the register or the wall and covers the outlet opening of the register. An air duct 64 within the wall 62 conveys air to the register. The apparatus further includes a flapper valve 66, a latch 67, a sail switch 68, and a control circuit within a cover 69, similar to the apparatus shown in FIGS. 1 to 5. Since the flapper valve 66 does not hang vertically downwardly from its hinge connection when it is in the open position, a biasing device 71 is provided to urge the flapper valve 66 to the open position. In the construction shown in FIG. 6, the bias device comprises a small weight 72 that is secured to the flapper valve 66 and which extends generally downwardly when the flapper valve is in the open position. Thus, the weight 72 urges the flapper valve 66 to the open position.

In the arrangement shown in FIG. 7, the biasing device comprises a torsion spring 73 that is connected between a flapper valve 74 and a back wall 76, the torsion spring 73 urging the flapper valve to its open position.

Figure 8:
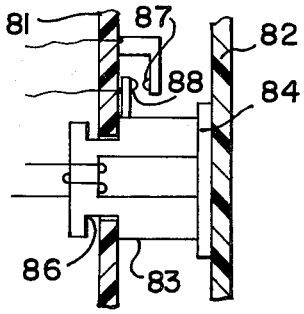
FIG. 8 illustrates an alternative switch construction.

The arrangement shown in FIG. 8 includes an alternative air flow responsive switch. The arrangement includes the back wall 81 of a housing and a flapper valve 82. A magnetic core 83 is mounted on the back wall 81 and a magnet 84 is mounted on the valve 82. Whereas the core 28 is firmly secured to the back wall 19, the core 83 is allowed to move slightly on the wall 81. The core 83 has a groove 86 in it that has a greater width than the thickness of the wall 81, and the wall extends into the groove 86. A stationary contact 87 is fastened to the back wall 81 and a movable contact 88 is fastened to the core 83 adjacent the contact 87. When air is not flowing through the housing, the magnet 84 engages the core 83 and moves the core toward the left, thereby holding the contacts 87 and 88 apart. When air starts to flow, the air pressure on the flapper valve 82 moves it toward the right and also brings the contact 88 against the contact 87. The contacts 87 and 88 serve the same function as the contacts 47 and 48 (FIG. 5), and they are connected in the control circuit of FIG. 3. Thus the arrangement of FIG. 8 serves both as a latch and as a sail switch.

The control circuit is readily adaptable to respond to various factors. In an air conditioning situation, the thermostatic switch 41 would be arranged to close with a temperature below a set point. Instead of a flow switch as shown, a switch could be connected to the blower which, when energized, would signify air flow through the housing. Additional control switches could be provided in series with the air flow switch and in parallel with the thermostatic switch, so that establishment of air flow would effect closure of the valve 22. Such additional switches may include a manual switch, a timer-operated switch that would be arranged to close only when it is expected that a room will be occupied, or a telemetry-operated switch that is connected to a central control transmitter. If all the rooms of a building are equipped with apparatus as described herein, the control circuits may be connected to turn off the blower when all or most of the flapper valves are closed.

The apparatus described previously serves to close or prevent air flow out of a register when a preset temperature level is reached, but it may not provide accurate temperature control of a room because the flapper valve will not open once it is closed and the air flow continues. This will be the case despite the fact that the air temperature in a room may drop after the valve has closed and the blower continues to operate. A close temperature control may be obtained by the following method using the apparatus described. When the blower is off, all of the flapper valves of a number of dampers in a system are open. The blower is started, and some or all of the dampers close, depending on the temperatures in the various rooms. The blower is programed to periodically turn off and then on again, rather than be continuously on until the preset temperature is reached. Each time the blower turns off, all of the dampers open, and when the blower turns on again the dampers in some of the rooms will remain open while others will reclose. Consequently, by cycling the blower on and off prior to reaching the preset temperature value, a close control of room temperature is obtained.

An air flow control and damper, as described herein, has numerous advantages. It may be included as part of the original forced air system or the dampers may be readily installed in an existing home by, for example, a "do-it-yourselfer", and it may be manufactured relatively inexpensively. The damper may be operated by a battery without the need for elaborate electrical connections, because only a short pulse is needed to enable closure of the flapper valve. The damper utilizes the force of the moving air to close it and, of course, the static air pressure holds it closed. All that is needed to close it is a short current pulse in the presence of air flow, and the valve automatically reopens when the air flow ceases.

What is claimed is:

1. Apparatus for controlling the flow of air from an outlet of a forced air system, comprising housing walls adapted to be mounted on and substantially enclose the outlet, said housing walls forming an air outlet opening, flapper valve means movably mounted on said walls adjacent said opening, said valve means being movable between a closed position where it blocks said opening and an open position where said opening is unobstructed, said valve means being located in the path of air moving from said outlet to said opening whereby the moving air exerts a force on said valve means, said force being in a direction to move said valve means to said closed position, latch means connectable to said valve means for releasably holding said valve means in said open position in opposition to said force, and control means for disabling said latch means.

2. Apparatus as in claim 1, wherein said valve means is mounted to be moved to said open position by its weight.

3. Apparatus as in claim 1, and further including means connected to said valve means for urging said valve means to said open position.

4. Apparatus as in claim 1, wherein said control means comprises air flow responsive means whereby said latch means is disabled only in the presence of air flow from said outlet and through said housing.

5. Apparatus as in claim 1, wherein said latch means includes an electromagnetic coil for disabling said latch means when electrically actuated, and electrical switch means connected to said coil and controlling actuation of said coil.

6. Apparatus as in claim 5, wherein said switch means comprises a first switch that is responsive to the ambient temperature, and a second switch that is responsive to the flow of air through said housing.

7. Apparatus as in claim 6, wherein said second switch comprises a sail switch that is movable in response to air flow.

8. Apparatus as in claim 6, wherein said second switch comprises a first contact fastened to one of said walls, and a second contact operatively connected to said valve means and movable therewith in response to said air flow.

9. Apparatus as in claim 6, wherein said second switch is connected to respond to energization of means for producing air flow through said register.

10. Apparatus as in claim 5 wherein said electromagnetic coil is fastened to one of said walls, and said latch means further includes a magnetic member attached to said valve means adjacent said coil when said latch means is in said open position.

11. Apparatus for controlling the flow of air from an air outlet of a forced air system, comprising a housing formed of a plurality of connected walls, said walls forming an air outlet opening and said housing being adapted to be connected to enclose said outlet, flapper valve means pivotably connected to said walls adjacent said opening and movable between an open position and a closed position, said valve means blocking said opening when in said closed position and unobstructing said opening when in said open position, said flapper valve means extending when in said open position in the path of air flowing through said housing and the flowing air tending to move said valve to said closed position, releasable latch means for holding said flapper valve means in said open position, said latch means including a magnetic member attached to said valve means, a magnetic core attached to one of said walls in position to be engaged by said member when said valve means is in said open position, and electric control means connected to said core for disabling said latch under preselected conditions.

12. Apparatus as in claim 11, wherein said control means comprises a coil on said core, electric pulse forming means, and switch means connecting said switch means to said coil.

13. Apparatus as in claim 12, wherein said switch means includes a thermostatic switch and a switch that is responsive to the flow of air through said housing.

14. A method of controlling the air flow in a forced air system including a blower, a plurality of air outlets, and ducts leading from said blower to said outlets, each of said outlets including a flapper valve that is movable to an open outlet position and to a closed outlet position, said valves being normally in said open outlet position and the force of air through the ducts and to the outlet acting to move the valve to the closed outlet position, a releasable latch for holding the valve in the open outlet position, and a control including a temperature sensor for releasing the latch at a present temperature level, said method comprising the steps of opening said flapper valves, engaging said latches, operating said blower to exert a force on each of said flapper valves, at each of said outlets sensing the temperature utilizing said sensor, and releasing the latch utilizing said control when the sensed temperature is displaced from said preset temperature.

15. A method according to claim 14, and further including the step of periodically turning the blower off and then on again, the flapper valves moving to the outlet open position when the blower is turned off.

* * * * *